US009347290B2

(12) United States Patent
Taylor

(10) Patent No.: US 9,347,290 B2
(45) Date of Patent: May 24, 2016

(54) FLUID-SAVING PUMP DOWN TOOL

(76) Inventor: R. Mickal Taylor, Tyler, TX (US)

( * ) Notice: Subject to any disclaimer, the term of this patent is extended or adjusted under 35 U.S.C. 154(b) by 706 days.

(21) Appl. No.: 13/430,820

(22) Filed: Mar. 27, 2012

(65) Prior Publication Data

US 2012/0247756 A1 Oct. 4, 2012

Related U.S. Application Data

(60) Provisional application No. 61/465,945, filed on Mar. 28, 2011.

(51) Int. Cl.
*E21B 33/128* (2006.01)
*E21B 23/14* (2006.01)

(52) U.S. Cl.
CPC ..... *E21B 33/1285* (2013.01); *E21B 23/14* (2013.01)

(58) Field of Classification Search
CPC . E21B 17/1078; E21B 17/1028; E21B 19/24; E21B 33/128; E21B 33/1285; E21B 23/14
USPC ..... 166/241.5, 153, 154, 155, 241.1, 241.6
See application file for complete search history.

(56) References Cited

U.S. PATENT DOCUMENTS 227,419 A * 5/1880 Dresser ..... E21B 33/128 277/338
350,655 A * 10/1886 Brooder ..... 277/342
2,704,980 A 3/1955 Vincent
2,714,855 A 8/1955 Brown
2,789,645 A 4/1957 Curnett et al.
2,859,827 A 11/1958 Elkins et al.
4,399,870 A 8/1983 Baugh et al.
4,858,705 A 8/1989 Thierv
6,557,631 B1 * 5/2003 Spencer et al. ..... 166/250.13
2010/0065280 A1 3/2010 Tetzlaff et al.

OTHER PUBLICATIONS

Geopro, Bimbar Inflatable Packers, Inflatable Packers forw Water Wells Applications, product information, product website, 2 pages, www.geopro.be/index.php/inflatabe-packers/water_wells.html.
Lansas Products website; Well Packers, product information; product website, 1 page, www.lansas.com/wellpack.htm.
Packe: General Information, 4 pages, www.baski.com/packer.htm.

* cited by examiner

*Primary Examiner* — Giovanna C Wright
*Assistant Examiner* — Kristyn Hall
(74) *Attorney, Agent, or Firm* — Gary P. Katz

(57) ABSTRACT

A fluid saver tool for deploying in a wireline string comprises a main shaft having a concentric seat attached to a lower end of the main shaft and a variable-diameter piston assembly concentrically disposed on the main shaft and seated against the concentric seat. A concentric thrust bushing is installed on the main shaft in contact with an upper end of variable diameter piston opposite from the concentric seat. The tool enables the deployment operation to be accomplished with much less water, lower pump pressures and energy losses, and substantially less time required to complete the operation.

21 Claims, 4 Drawing Sheets

FLUID-SAVING PUMP DOWN TOOL

CROSS-REFERENCE TO RELATED APPLICATION

The present application claims priority from the earlier filed provisional application, U.S. Ser. No. 61/465,945, filed Mar. 28, 2011, entitled "Fluid Saver Tool" by the same inventor, R. Mickal Taylor.

BACKGROUND OF THE INVENTION

1. Field of the Invention

The present invention generally relates to instruments for use in oil and gas drilling operations and more particularly to apparatus for transporting such instruments within a well.

2. Background of the Invention and Description of the Prior Art

Transporting oil and gas instruments and tools within a well bore is typically accomplished by gravity for vertical wells and with water pumped under high pressure for wells that have laterals or horizontal paths. In the latter case, after the tool or other instrumentation is lowered into the well bore and suspended on the wireline, water is pumped in high volumes under high pressure into the well to force the tool package through the well casing. A typical tool has a diameter that presents some obstruction in the casing to the flow of water to enable the water pressure to push against the tool, forcing it along the interior of the casing. Nevertheless, because the tool is not a complete obstruction to the flow of water, a substantial portion of the water flows past the tool below or beyond the position of the tool in the well.

The disadvantages of this "lost" or wasted water, and the additional pump pressure required to compensate for the losses due to leakage past the tool, include the use of more water lost to other beneficial uses, the need for more powerful pumps and the excess energy required to develop sufficient pump pressure to overcome the losses due to the lack of full obstructive effect of the tool, and the extra time required to complete the transport of the tool to the desired position in the well. Other disadvantages include the inability to transport a tool in badly deviated wells, contamination of more water than necessary if the amount of water required could be reduced, reduced washing effects on composite plugs that are located below the tool being transported, and of course the monetary losses that accompany these inefficiencies. This problem, if solved, would substantially improve the efficiency of operations in horizontal wells, particularly in the placement and recovery of tools and the like.

The prior art includes devices that, when sized for use in a well casing of a known diameter can be used to alternately provide a blocking effect or a pass-through feature responsive to the hydrostatic pressure in the well bore. As a blocking device attached to an instrument string, the instrument string can be fixed in a desired stationary position in the well bore. As a pass-through feature, fluid is allowed to flow freely through the device and the well casing. Such a device is disclosed in U.S. Pat. No. 4,399,840 issued to Baugh et al., which "has a ball [adjustable] between an open position to allow flow through the drill string for testing and a closed position to block flow. Operating means convert the ball between an open and closed position in response to pressures in the well annulus." However, to adapt such a device to the objective of moving or conveying an instrument through a well casing, the ball or other blocking device would need to be carefully sized for use in each specific casing size, so as to obstruct the flow of most of the fluid past the device but not such a close fit within the casing as to not move freely through the casing. Moreover, due to the variety of casing sizes and the likelihood of variation in the inside diameter of well casings, such a device would be impractical because of the associated costs and compromises to provide a device that would work reliably regardless of the casing inside diameter. For example, a different size blocking device would be required for each casing diameter, and the associated housing and support structure for accommodating each size, including the mechanism for changing its orientation with respect to the direction of flow, would be expensive in both costs of manufacture and operation.

Another prior art device is a well packer, a device that is configured for blocking and sealing a well casing at some desired location fixed within the well bore. Some are formed by mechanical structures such as sliding wedges that have surfaces to conform to the circular well casing that can be operated to expand after placement into a stationary position to occupy the entire cross section of the well casing. These tend to be complex and typically require sealing to be effective in "packing" the well bore, i.e., acting as a plug in the well casing. Others may be constructed as inflatable devices. While these may be adaptable to differing well casing diameters, and may even be able to provide the sealing action required in a packer, they require a mechanism to inflate them, which may be an added complexity in their use. Further, packers are intended to be installed at a desired position and left in place. A well packer is used as a stationary device to plug the well at a desired location. It is not intended to move to fulfill its function. This is in contrast to the need to provide a device that must move readily to transport or convey a tool through a well bore, including a horizontal well, to a specific location using water pressure, and thereafter removing the device because it is no longer needed for moving the tool.

What is needed is a practical way to reduce the amount of water and water pressure required to transport a tool through the casing, while speeding the process to accomplish the objective in less time. A practical solution must be inexpensive to manufacture, easy to use, reliable, reusable, and able to withstand the severe operating conditions found in a well bore, particularly one involving substantial lateral passages and passages that are badly deviated. A deviated well is one in which the well bore deviates from the vertical direction, as in horizontal drilling or changing the course of the well bore to reach an objective not in a vertical line with the well bore at the surface.

SUMMARY OF THE INVENTION

Accordingly there is disclosed a fluid saver tool that, when deployed in a wireline string with the instruments being lowered and positioned in a well, enables the deployment operation to be accomplished with much less water, lower pressures and energy losses, and substantially less time required to complete the operation.

A fluid-saving pump down tool comprises a variable diameter piston assembly formed as a resilient, expandable cylindrical member for being disposed in wireline string between a fixed seat and a sliding thrust bushing and configured to expand its diameter in the presence of a high volume fluid flow within a well casing and contract its diameter in the absence of the high volume fluid flow.

In one aspect a fluid-saving pump down tool comprises a main shaft having a concentric seat attached to a lower end of the main shaft and a variable-diameter piston assembly concentrically disposed on the main shaft and seated against the concentric seat. A concentric thrust bushing is installed on the main shaft in contact with an upper end of variable diameter piston opposite from the concentric seat.

In another aspect, the variable diameter piston assembly comprises a hollow cylindrical member formed of an elastomeric or rubber material. The cylindrical member may have a thinner wall thickness along a central portion thereof than the wall thickness at each end of the cylindrical member. The cylindrical member may have a constant outside diameter and an inside diameter that is greater along the central portion than at and near the ends of the cylindrical member.

In another aspect, the variable-diameter piston assembly comprises an internal helical spring concentrically disposed on the main shaft within the cylindrical member and seated against the concentric seat.

In another aspect, the helical spring comprises a helical coil formed of spring steel having an outside diameter substantially equal to the nominal inside diameter of the cylindrical member, a length substantially equal to the length of the cylindrical member, and a tension within the range of 50 to 80 pounds when compressed to half its length.

In another aspect, the variable diameter piston assembly includes an expansion-limiting spacer disposed between the lower end of the helical spring within the cylindrical member and the concentric seat, whereby the spacer is supplied in a variety of thicknesses corresponding to the inside diameter of the well casing with which the fluid saver tool will be used.

In operation, when inserted into the wireline of a string, the cylindrical member, in cooperation with the concentric seat fixed to the main shaft and the concentric thrust bushing, which is configured to slide along the main shaft, forms a variable diameter piston assembly that expands under the water pressure provided from surface pumps, and contracts to its nominal diameter when the pump pressure ceases. The expansion of the variable diameter piston assembly fills the cross section of the well casing by a predetermined amount so that the amount of water and pressure leakage around the fluid saver tool is minimized. Accordingly, substantially all of the water (or other fluid) volume and pressure applied to the fluid saver tool is utilized in transporting the tool string down and through the well casing. When the tool is in the desired position, the water pressure is reduced and the helical spring and inherent resilience in the cylindrical member supplies a restoring force to return the cylindrical member to its relaxed cylindrical form, allowing water or other fluids to flow past the fluid saver tool for other operations. The spacer disposed on the main shaft provides an adjustment shim to reduce the contraction of the helical spring for smaller diameter casings so that the amount of expansion of the variable diameter piston assembly matches the inside diameter of the well casing without making a tight sealing contact in the presence of the water pressure used to drive the instrument string through the well bore.

DETAILED DESCRIPTION OF THE INVENTION

Figure 1:
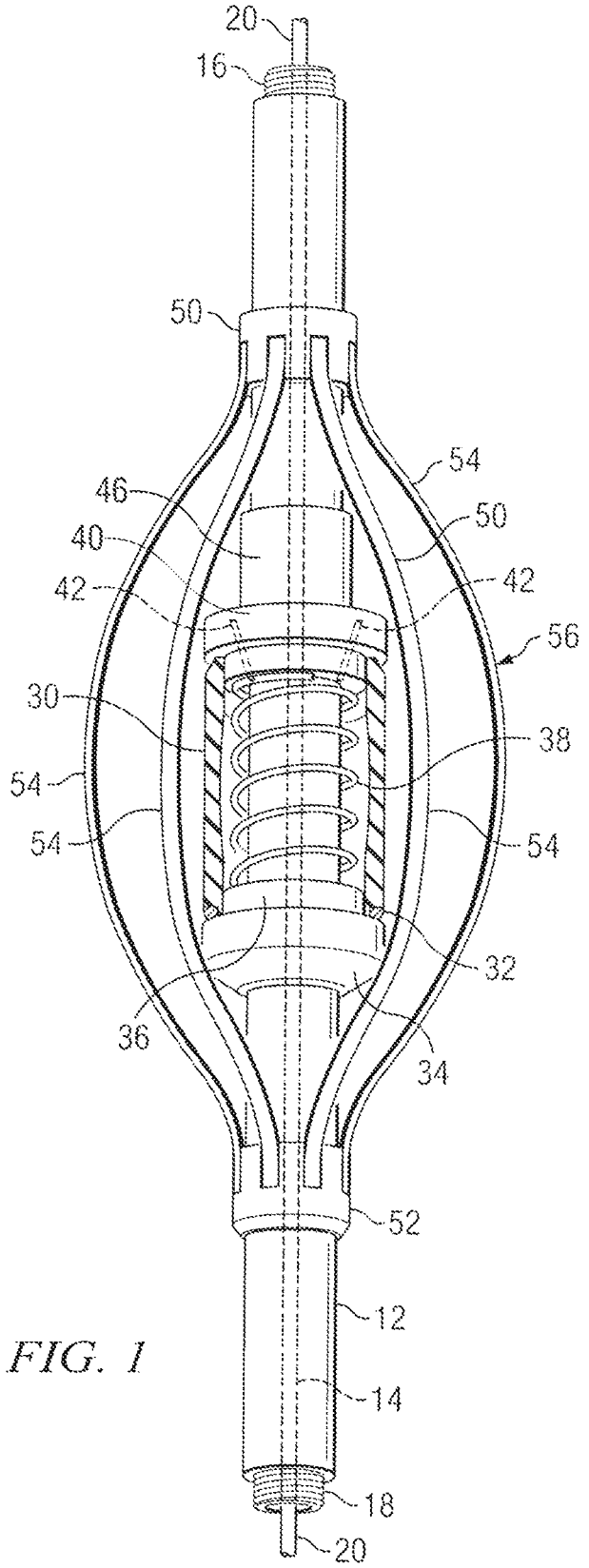
FIG. 1 illustrates a side perspective view of one embodiment of a fluid saver tool according to the present invention.

The following detailed description, read in conjunction with the drawings provided herein, is intended to be illustrative of the principles of the invention. The illustrated embodiments are accordingly not intended to be limiting of the scope of the invention as set forth in the appended claims to the invention. In the drawings reference numbers are retained and carried forward for structures that appear in multiple figures.

Completion of horizontal wells, particularly in the oil and gas drilling field, presents challenges not heretofore existent in traditional vertical well operations. Wireline services are employed to provide important and critical services in this completion activity. Horizontal wells are typically not only deeper but often extend thousands of feet into one or more horizontal paths or "laterals" that extend the distance through which wireline tools to be deployed must be transported or conveyed. In conventional practice, high volumes of fluid are pumped under high pressures against the wireline tools to transport—literally "force"—them to the desired depth. This technique is inefficient and wasteful of fluid and energy because much of the fluid—usually water—bypasses the tool being deployed and requires pumps having higher horsepower motors to overcome the pressure losses due to the fluid bypass.

The fluid saver tool described herein solves this long-standing problem by providing a tool to insert in the wireline string. Although it is often installed above or near the upper end of the other tools in the string, this is not a requirement because the fluid saver tool described herein may be installed anywhere in the wireline string. The fluid saver tool has a variable-diameter piston that is caused to expand by the pressure of the fluid being used to transport the string of wireline tools. The variable diameter piston includes a resilient, expandable cylindrical member disposed in the wireline string and configured to expand its diameter in the presence of high volume fluid flow within the well casing and contract its diameter in the absence of the high volume fluid floe. The variable diameter piston thus expands to a diameter near the inside diameter of the well casing and contracts to its nominal or quiescent diameter depending on the presence or absence of fluid flowing through the well casing at a relatively high volume. The high volume fluid flow may be supplied by pumping the fluid from the surface, for example.

When the variable diameter piston assembly in the fluid saver tool is fully expanded, it occupies nearly all of the inside cross section of the well casing so that it functions as a piston in a cylinder, enabling the piston assembly to move along the well casing with the high volume flow of the fluid being pumped into the well casing. The key functional aspect of the variable diameter piston assembly is that it moves within the well casing as it fulfills its primary function. It does not remain stationary except when it reaches the desired position of the wireline tool string in the well and the flow of fluid is stopped, causing the variable diameter piston assembly to contract to its quiescent condition so that it no longer blocks the flow of fluid material.

In an illustrated embodiment of the present invention, the pressure of the fluid pumped into the well casing, which arises from a high volume of fluid being pumped, pushes against a thrust bushing that bears against the variable piston, overcoming the tension of an internal spring, to compress the length of the variable piston so that it expands its diameter to substantially fill the inside diameter of the well casing. Thus, the fluid being pumped into the well casing presses against the entire cross sectional area of the expanded piston and very little fluid is allowed to bypass the fluid saver tool. The tool and the wireline string attached to it are thus transported with much less fluid and much less energy needed to drive the pump being required to deploy the tools to the desired depth or position. When the tools are fully deployed, the pump pressure is removed and the variable piston contracts back to its quiescent condition under the restoring action of the internal spring and the resilient cylindrical member as will be described. Fluids are then enabled to bypass the fluid saving tool as other operations are carried out. The fluid saver tool may be equipped with spring steel centralizing springs to maintain the tool in alignment with the well casing centerline, primarily to prevent the variable-diameter piston from rubbing against the interior of the well casing.

The cost savings that result from the use of the fluid saver tool are substantial and include much less fluid use (and the associated costs of making it available to the drilling site), lower pump flow rates and reduced energy required to operate the pump, less contamination of the formation, and faster wireline run times. Further, the fluid saver tool enables tools to be deployed in badly deviated wells, even those having positive inclines deep below the earth's surface. For example, the fluid saver tool can be successfully used in an inclined lateral of 110° or more. The tool may also be adapted to fishing operations and may also, when used with composite bridge plugs, result in lower washing effects.

FIG. 1 illustrates a perspective view of one embodiment of a fluid saver tool according to the present invention. The fluid saver tool 10 is disposed along a main shaft 12 having a bore 14 centered along its longitudinal axis to receive a wireline conductor. At the upper end of the main shaft 12 is a coupling device 16 for connecting the tool 10 into a wireline string (not shown as it is well known in the art). Similarly a coupling device 18 is disposed at a lower end of the main shaft 12 for connecting to the wireline string. The bore 14 is provided to accommodate an insulated electrical conductor 20 that may be used with the fluid saver tool 10. The electrical conductor 20 (not shown) may preferably be insulated with a material resistant to high temperatures and harsh chemicals.

Figure 4:
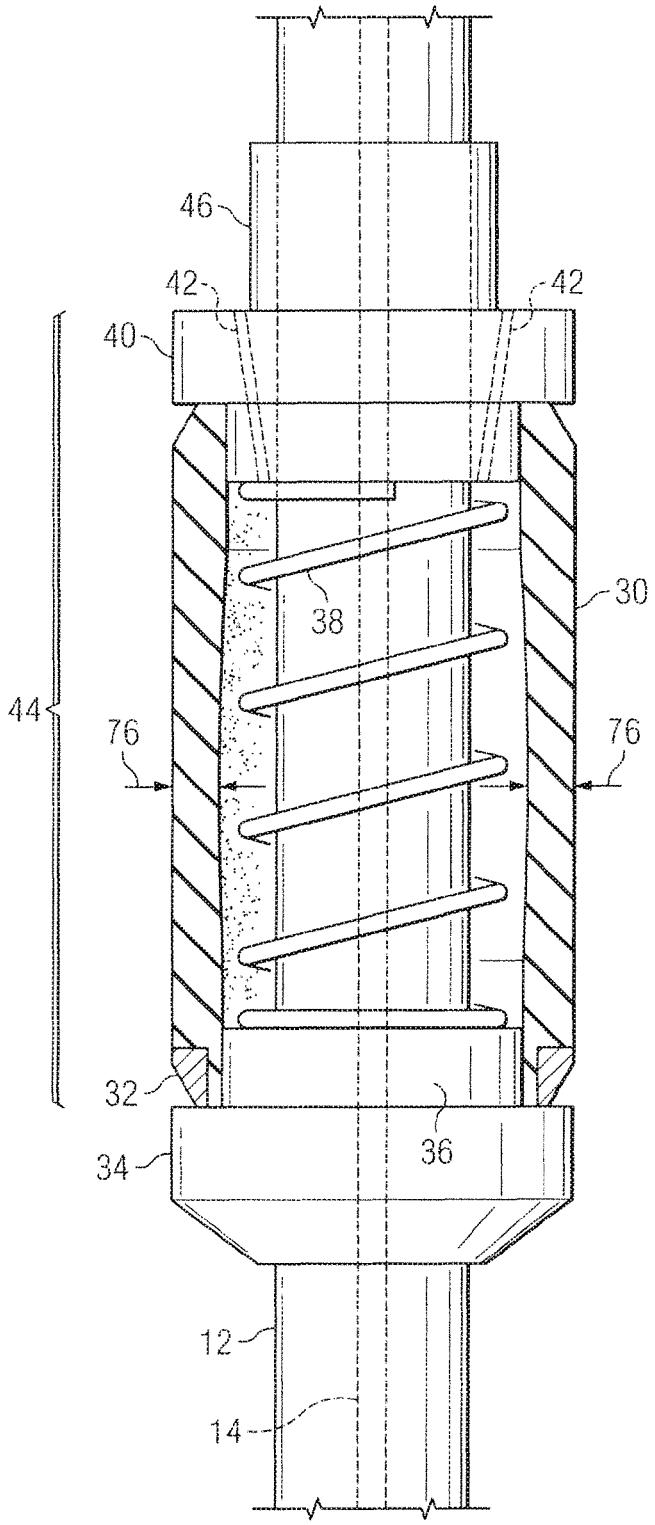
FIG. 4 illustrates a side cross section view of a variable diameter piston assembly for use in the embodiment of FIG. 1.
Figure 5:
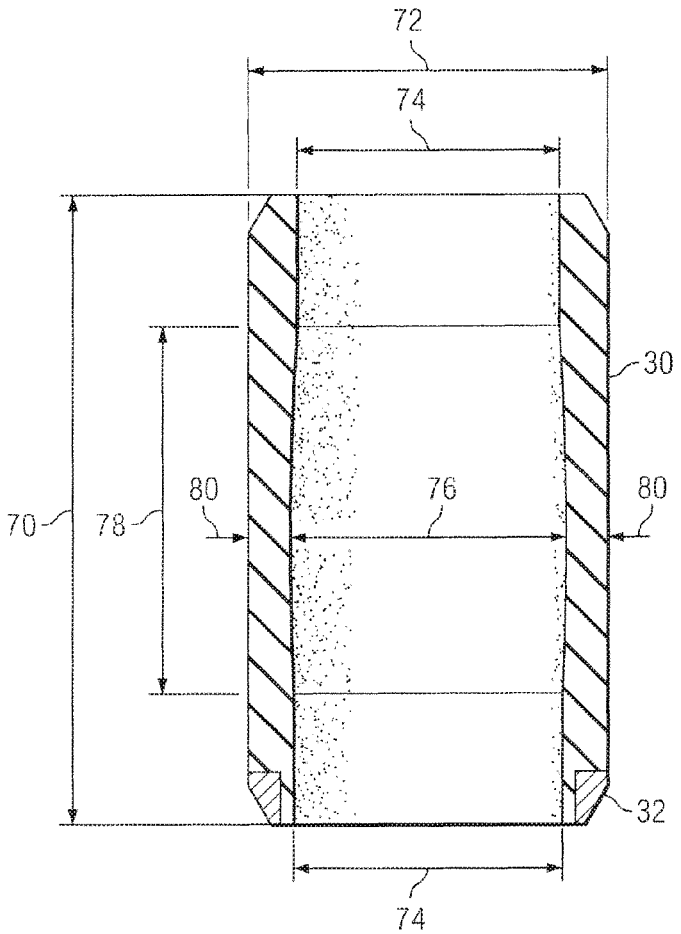
FIG. 5 illustrates a side cross section view of an expansion body comprising a hollow cylindrical member configured for use in the variable diameter piston assembly of FIG. 4.

Continuing with FIG. 1, the variable diameter piston assembly 44 will be described. Disposed concentric with the main shaft 12 is a cylindrical member 30 having a retaining ring 32 integrally attached thereto at a lower end of the cylindrical member 30. The cylindrical member 30 and the retaining ring 32, an assembly further described in FIGS. 4 and 5, is seated against a piston assembly seat 34 that is also concentrically disposed about the main shaft 12. The piston assembly seat 34 is secured to the main shaft 12 by secure mechanical means well known in the mechanical arts such as set screws (not shown) and the like. Disposed within the cylindrical member 30 and seated against the piston assembly seat 34 is a floating expansion limiting spacer 36. The lower end of an internal helical spring 38 is also disposed within the cylindrical member 30 and shown seated against the spacer 36. A sliding thrust bushing 40, concentrically disposed around the main shaft 12 is positioned in contact with the upper end of the cylindrical member 30 and the upper end of the internal helical spring 38. The thrust bushing 40 includes a plurality of equalizing slots or ports that pass through the thrust bushing into the interior portion of the cylindrical member. The assembly of components 30, 32, 36, 38, and 40 together form the variable diameter piston assembly 44. A stop collar 46 is secured to the upper end of the main shaft 12 to limit the travel of the thrust bushing 40 as the variable diameter piston assembly expands along the main shaft 12 when restoring the piston assembly 44 to its quiescent length as will be explained.

The fluid saver tool 10 may also be equipped with a centralizing device 56. In the example illustrated a plurality of centralizer or "bow" springs 54 are connected at a first end thereof to a first bow spring housing 50 and at a second end thereof to a second bow spring housing 52. Although not a specific requirement, the first bow spring housing 50 may be disposed toward the upward end of the main shaft 12 and the second bow spring housing 52 toward the lower end if the main shaft 12. The first bow spring housing 50 may be secured to the main shaft 12 by conventional means well known in the mechanical arts (not shown) and the second bow spring housing 52 may be configured to slide along the main shaft 12 as the bow springs 54 flex when in contact with the inside wall of the well casing (see FIGS. 2 and 3). The bow springs 54 may be formed of spring steel selected for the purpose, as is well known in the art. The centralizing device 56 is used primarily to keep the variable diameter piston assembly 44 from rubbing against the inside wall of the well casing and causing undue wear and premature failure. The centralizing function is also operative to ensure full expansion of the variable diameter piston assembly 44 for the most efficient operation of the fluid saver tool 10.

Figure 2:
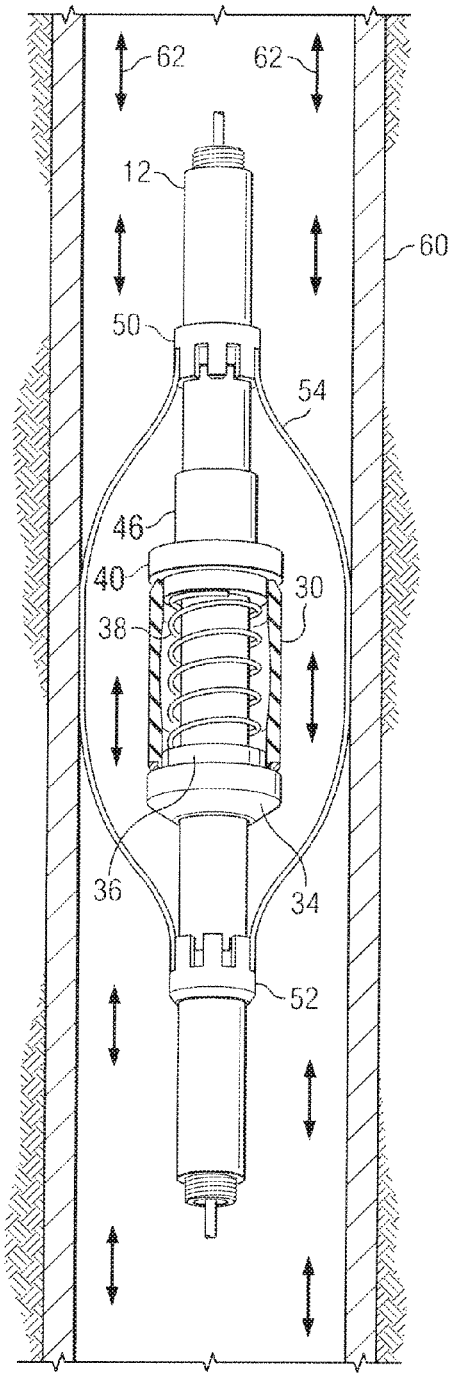
FIG. 2 illustrates a cross section view of the embodiment of FIG. 1 inserted in a well casing in a static condition with no fluid being pumped into the well and showing that fluid may flow freely past the device.

FIG. 2 illustrates a cross section view of the embodiment of FIG. 1 inserted in a well casing 60 in a static condition with no water being pumped into the well and the fluid saver tool 10 disposed in a quiescent state or condition as it would be with no fluid being pumped into or through the well casing 60, or with fluid 62 flowing in the well casing but not being pumped under pressure.

Figure 3:
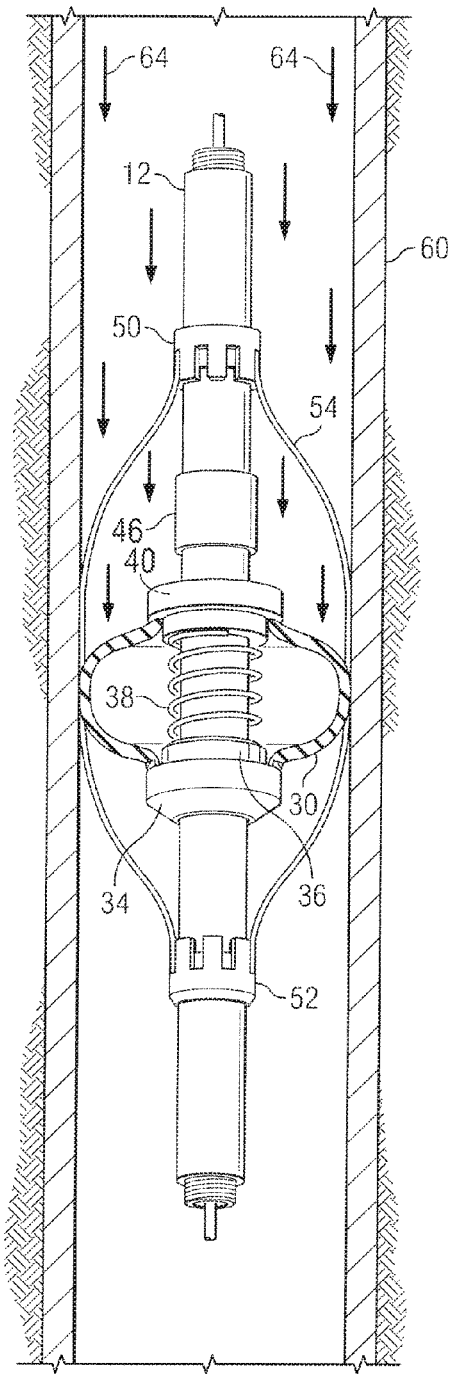
FIG. 3 illustrates a cross section view of the embodiment of FIG. 1 inserted in a well casing in a pressurized condition with fluid under pressure being pumped into the well and showing the flow of fluid substantially impeded.

The well casing in both FIGS. 2 and 3 is shown proportionately larger than scale relative to the fluid saver tool to more clearly depict its operation. The arrows are provided to show the free flow, in either direction, of fluid 62 past the fluid saver tool 10 when it is in a quiescent state. The well casing 60 and the fluid 62 do not form part of the invention. In the quiescent state, the cylindrical member 30 of the variable diameter piston assembly 44 is relaxed to its static nominal diameter as shown in FIG. 4, and restored to its full length under the action of the internal spring 38. In this state, the cylindrical member 30 and internal spring 38 are fixed in position between the spacer 36 and piston assembly seat 34 and the thrust bushing 40 and stop collar 46. It will be recalled that both the piston seat 34 and the stop collar 46 are secured to the main shaft 12.

FIG. 3, which is similar in most respects to FIG. 2 including the identified structures of the fluid saver tool 10, illustrates a cross section view of the embodiment of FIG. 1 inserted in a well casing 60 in a pressurized condition with fluid 64 under pressure being pumped into the well and showing the cross section of the casing is filled substantially by the variable diameter piston assembly 44. In this condition the fluid saver device 10 and other instruments connected to it in the wireline are caused to move readily through the well casing 60. The well casing 60 and the fluid 62 do not form part of the invention. In the pressurized state, the cylindrical member 30 of the variable diameter piston assembly 44 is expanded to its full diameter, substantially filling the inside diameter of the well casing 60. The piston thus formed enables the fluid pressure to bear against it and cause the wireline string connected to it via the main shaft 12 to be conveyed downstream through the casing 60. The pressure of the fluid having exceeded the tension in the internal spring 38, the length of the piston assembly 44 is contracted as the diameter expands. In this state, the cylindrical member 30 and internal spring 38 are forced against the piston assembly seat 34 and the thrust bushing 40 is shown in a position below the stop collar 46.

FIG. 4 illustrates a side cross section view of one embodiment of the variable diameter piston assembly 44 for use in the fluid saver tool 10, including the same structural features of the piston assembly 44 that are depicted in FIG. 1, but in a larger view to show the relationship of the components and further details of their construction. For example, the cylindrical member 30 in this illustrated embodiment may be formed by molding of a nitrile rubber material having a nominal Shore durometer ("A" Scale) of approximately 70. The nitrile rubber cylindrical member 30 is bonded to a mild steel retaining ring 32 during the molding process to reinforce and give a stable shape to the cylindrical member 30 during the operation of the fluid saver tool 10.

An important feature of the cylindrical member 30 illustrated in FIGS. 4 and 5 is the variation of its inside diameter within the central portion 72 of the length 70 of the cylindrical member 30. As will be described, the cylindrical member 30 becomes an expansion body when subject to high pressure fluid pumped into the well bore. The cylindrical member 30 has a defined length 70, a constant outside diameter 72, and a variable inside diameter 74, 76. Near the open ends of the cylindrical member 30 the inside diameter is a constant value 74. In the central portion 78 of the cylindrical member 30 the inside diameter 76 is increased by a predetermined amount (see FIG. 5). The inside diameter 76 is increased from the nominal inside diameter 74 of the cylindrical member 30, at approximately one quarter of the length 70 from each end of the cylindrical member 30, toward the longitudinal center of the cylindrical member 30 where the inside diameter 76 is at a maximum value. The purpose of this increased diameter is to reduce the wall thickness 80 of the cylindrical member 30, enabling it to flex when the cylindrical member 30 is under pressure in the direction of its longitudinal axis. This causes the cylindrical member 30 to bulge outward under the pressure of the fluid being pumped into the well bore, thus expanding the outside diameter of the cylindrical member 30 and the variable diameter piston assembly 44. It is this action that causes the fluid saver tool 10 to substantially fill the inside diameter of the well casing 60 forming a piston that enables the wireline string connected to the fluid saver tool 10 to be pushed more efficiently with less fluid and pump pressure required to deploy the wireline string to the desired depth. When the pump pressure is removed, the resilient property of the nitrile rubber material restores the cylindrical member 30 to its original nominal outside diameter and the internal spring 38 urges the thrust bushing 40 back to its quiescent position along the main shaft 12, allowing the cylindrical member 30 to return to its nominal full length 70.

FIG. 5 depicts a side cross section view of an expansion body for the variable diameter piston assembly 44 comprising the hollow cylindrical member 30 illustrated in FIG. 4. As described herein above, the cylindrical member 30 is formed by molding of a nitrile rubber material that is bonded to a machined, mild steel retaining ring during the molding process. The nitrile rubber is chosen to have a Shore "A" Scale durometer of 70 in this illustrative example to enable expansion of the cylindrical member 30 when under longitudinal compression force as when fluid is pumped into the well bore under high pressure. As described, the inside diameter 76 of the central portion 78 of the cylindrical member 30 is increased by a predetermined amount from the nominal inside diameter 74 of the cylindrical member 30, beginning approximately one quarter of the length 70 from each end of the cylindrical member 30 and increasing toward the approximate longitudinal center of the cylindrical member 30 where the inside diameter is at a maximum value 76. While the exact position of the point where the inside diameter begins to increase is not critical, it is important that the inside diameter increase gradually toward the central portion of the cylindrical member, by just enough to ensure that the central portion of the cylindrical member will flex outward to expand toward the well casing to impede the flow of fluid and cause the tool string to move. The amount of increase in the inside diameter will depend on the particular application. There must be enough increase to permit the expansion of the variable diameter of the piston assembly at the proper fluid volume of flow, and enough resiliency in the cylindrical member to resist the fluid flow sufficiently to maintain stable operation and assist in the return of the cylindrical member to its relaxed, quiescent state when the flow of fluid ceases.

In the example depicted in FIG. 5, the cylindrical member 30, at six inches long, and nominally 3⅜ inches in outside diameter 72 and 2½ inches in nominal inside diameter 74, is sized for use with a nominal well casing outside diameter of 4½ inches and inside diameters in the range of 3½ to 4¼ inches. The inside diameters of the well casing, as is well known, may vary depending on the weight of the casing sections. These inside casing diameters correspond to a range of cylindrical member lengths of 5½ to 4½ inches. The compressed length of the cylindrical member 30 is adjustable in the fluid saver tool 10 according to the present invention, by varying the thickness (in the direction of the longitudinal axis of the main shaft) of the expansion limiting spacer 36 as shown in FIG. 4. For use with a casing inside diameter of 3½ inches the thickness of the spacer 36 may be approximately 1⅜ inches; for a casing having an inside diameter of 4¼ inch, the spacer thickness may be approximately ¾ inch thick. When restored to its full length, the cylindrical member 30 is six inches long in this typical example.

Variations in the construction of the illustrated embodiment are contemplated to adapt the fluid saver tool to different sizes of well casings. For example, the dimensions of the components, the tension of the spring, and the durometer rating of the material used for the resilient cylindrical member may all be varied to the scale of the particular application. Materials other than the nitrile rubber suggested herein may be suitable provided it has the necessary properties as to durometer, resistance to toxic or harsh chemicals, durability and abrasion resistance, and the ability to be machined or molded to fabricate the component, etc. Some embodiments may use alternate placement of the helical spring or even a spring configured as other than a helical form or coil. The spring may be embedded within the body of the cylindrical member during, for example, a molding process. In some configurations the spring may be eliminated if the material used for the cylindrical member has sufficient resiliency to resist the fluid flow in the application until an appropriate level is reached to cause the fluid saver tool to begin to traverse within the well casing. In the present illustrated example, the tension in the helical spring is set at about 70 lb. when compressed to the point where the cylindrical member begins to expand toward the inside wall of the well casing. In the embodiment described herein the inherent tension in the cylindrical member 30 to be overcome by the pressure of the fluid flow is approximately 65 lb. at the point where the expansion of the cylindrical member begins. The sum of these two figures, 135 lb. in this example, is thus the threshold where expansion is initiated.

Operation of the fluid saver tool for the embodiment depicted herein is described as follows. Typically, tools can be lowered in a well by gravity until the inclination from vertical reaches 60 or 70 degrees, after which fluid—usually water—is pumped into the well under high pressure to cause the tool string to continue its movement through the well. In some instances the pump pressure is applied when the inclination is in the range of 30 to 60 degrees. At 90 degrees' inclination the required volume of flow to get the tool moving is typically 10 to 12 barrels (bbls.) of fluid per minute without the fluid saver tool and approximately 4 to 6 barrels per minute when using the fluid saver tool. This reduction in the amount of fluid or water required represents a very substantial saving of fluid and energy to operate the pump, and the operation is generally completed in much less time, all of which are among the economic benefits of the fluid saver tool disclosed herein.

To continue with the above example, at approximately 135 lb. pressure exerted on the fluid saver tool the cylindrical member 30 begins to expand. This corresponds roughly to approximately 1.2 to 1.8 barrels per minute of fluid flow. The expansion of the cylindrical member 30 in the variable diameter piston assembly 44 continues as the fluid flow volume increases to 4 to 6 barrels per minute corresponding to approximately 475 lb. of pressure exerted on the piston assembly, at which point the tool string begins to move. These illustrative figures for a typical example involving a typical tool string in a typical well, are presented as a comparison to placing a tool string without using the fluid saver tool under the same conditions, wherein the amount of fluid is in the range of 10 to 12 barrels per minute. Many conditions can effect these numbers, such as the inclination, depth of the well, length of the tool string, diameter of the well casing, whether there are obstructions or other impediments to the movement of the tool string or the flow of fluid, etc.

Figure 6:
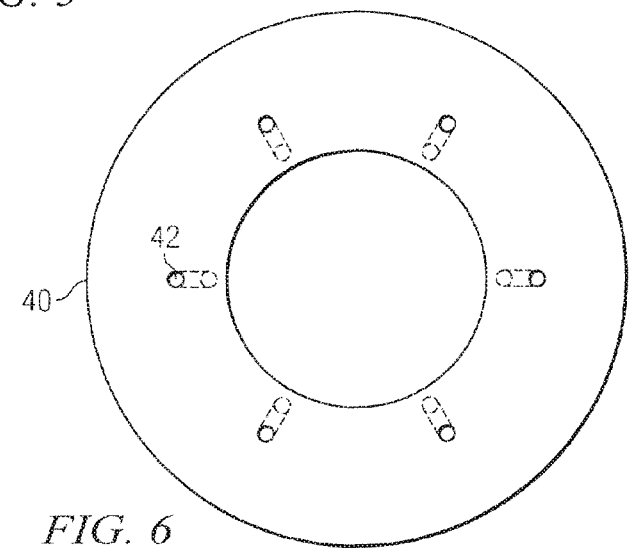
FIG. 6 illustrates a top-down plan view of a thrust bushing for use in the variable diameter piston assembly of FIG. 4.

FIG. 6 illustrates a top-down plan view of a thrust bushing for use in the variable diameter piston assembly of FIG. 4. The thrust bushing 40 may be machined from mild steel, and dimensioned to match the configuration of the cylindrical member 30, internal helical spring 38, and the main shaft 12 when these components come into contact during operation of the fluid saver tool 10. Additionally, a number of equalizing ports 42, typically six are provided at substantially equal intervals around the circumference of the thrust bushing 40, may be provided through the thrust bushing 40 approximately parallel to the longitudinal axis of the main shaft 12. These ports 42 equalize the fluid pressure inside the variable diameter piston assembly 44 with the fluid pressure outside of it.

It is important to realize that it is the pressure of the fluid pumped at a high volume flow into the well casing 60 that exceeds the combined tension in the internal helical spring 38 and the resiliency inherent in the cylindrical member 30 to cause the thrust bushing 40 to begin movement along the main shaft 12 and the variable diameter piston assembly 44 to expand. As the expansion of the variable diameter piston assembly 44 expands to the inside diameter of the well casing 60, movement of the fluid saver tool 10 is enabled and the wireline connected to it to deploy the wireline assembly connected to the fluid saver tool 10 in the well bore. The equalization ports 42 ensure that the pressures within the variable diameter piston assembly 44 are the same as the external pressure so that the operation of the variable diameter piston assembly 44 is not impaired. Persons skilled in the art will realize that the mechanism of operation of the variable diameter piston assembly 44 is not inflation of the cylindrical member 30 because the equalization ports ensure that the pressures within the cylindrical member 30 remain the same as the pressures external to it. The mechanism that causes the variable piston assembly 44 to expand is the high volume flow of fluid pumped into the well casing from the surface as described herein.

While the invention has been shown in only one of its forms, it is not thus limited but is susceptible to various changes and modifications without departing from the spirit thereof. In one alternative embodiment the helical spring 38 disposed within the cylindrical member 30 may be placed outside the cylindrical member in tension between the thrust bushing 40 and a collar stop 46. This configuration provides most of the restoring force to the cylindrical member 30 when the fluid pressure is reduced and thereby allows the diameter of the variable diameter piston assembly 44 to return to its quiescent length. In other words, an external helical spring may be used to extend in the presence of the fluid pressure and contract when the pressure is removed to "pull" the cylindrical member 30 back to its original or quiescent length. This alternate embodiment provides a fluid saving tool better adapted to smaller diameter well bores.

In another embodiment, the helical spring may be disposed outside the cylindrical member in combination with the concentric seat and thrust bushing adapted to operate with this alternate placement of the spring, whereby the fluid saver tool would function similarly to the illustrated embodiment. In yet another variation of the illustrated embodiment a spring member may be embedded within the body of the cylindrical member with similar results operationally. Alternatively, the cylindrical member itself may be configured with sufficient inherent resiliency to function as a variable diameter piston assembly without requiring a separate spring member to supply the resilient property. Further, the variable diameter piston assembly may be constructed of other materials and employ mechanisms other than spring-aided resilient materials as long as it affords the property of expanding in the presence of high volume fluid flow within the well casing and contracting back to its nominal diameter when the fluid flow ceases. Such embodiments are contemplated by the present invention and encompassed within the scope of the appended claims without limitation to the particular construction features of the embodiment illustrated herein above, which is provided to demonstrate in one example the principles of the invention.

Thus is provided a fluid saver tool having a variable diameter piston assembly formed as a resilient, expandable cylindrical member for being disposed in wireline string and configured to expand its diameter in the presence of a high volume fluid flow within a well casing and contract its diameter in the absence of the high volume fluid flow.

What is claimed is:

1. A fluid-saving pump down tool to transport a wireline tool string downward through a well casing, comprising:

a main shaft having a concentric seat fixed thereto toward a lower end of said main shaft;

a hollow expandable cylinder forming a variable-diameter piston concentrically disposed on said main shaft and seated against said concentric seat;

a bow spring assembly surrounding said variable-diameter piston and fixed to said main shaft located at one end of said bow spring assembly; and a sliding thrust bushing configured to slide along said main shaft outside said hollow expandable cylinder spring assembly;

said hollow expandable cylinder formed of an elastomeric material and having a reduced wall thickness intermediate a defined length thereof, wherein said reduced wall thickness intermediate said defined length thereof flexes outward under fluid pressure from fluid pumped into a wellbore, and wherein said fluid pressure from said fluid pumped into said wellbore bears against said variable-diameter piston causing said wireline string tool to be conveyed through said well casing.

2. The apparatus of claim 1, wherein:

said sliding thrust bushing outside said hollow expandable cylinder is a concentric thrust bushing installed on said main shaft in contact with an upper end of said variable-diameter piston opposite said concentric seat.

3. The apparatus of claim 2, wherein said variable-diameter piston comprises:

the hollow expandable cylinder having predetermined inside and outside diameters; and an internal helical spring concentrically disposed on said main shaft within said variable-diameter piston and seated against said concentric seat.

4. The apparatus of claim 3, wherein said inside diameter of said variable-diameter piston comprises:

a predetermined first dimension at each end of said hollow expandable cylinder, said first dimension increasing a predetermined amount from a first distance from said each end of said hollow expandable cylinder toward a second dimension approximately half way between said each end of said hollow expandable cylinder.

5. The apparatus of claim 3, wherein said internal helical spring comprises:

a helical coil formed of spring steel having an outside diameter substantially equal to a nominal inside diameter of said hollow expandable cylinder, a length substantially equal to said defined length of said hollow expandable cylinder and a tension within the range of 50 to 80 pounds when compressed to half of said length.

6. The apparatus of claim 3, further comprising:

a circular spacer, having a height dimension along a longitudinal axis of said main shaft and said predetermined inside and outside diameters, concentrically disposed on said main shaft within said hollow expandable cylinder between a lower end of said internal helical spring and said concentric seat.

7. The apparatus of claim 6, wherein said height of said circular spacer is variable in correspondence with an inside diameter of said well casing in which the fluid-saving pump down tool is deployed.

8. The apparatus of claim 2, wherein said variable-diameter piston assembly comprises:

said hollow expandable cylinder having predetermined inside and outside diameters; and an external helical spring concentrically disposed on said main shaft outside and above said variable-diameter piston and seated against said concentric thrust bushing.

9. The apparatus of claim 1, wherein said elastomeric material has a durometer between 60 and 80.

10. The apparatus of claim 1, wherein:

said bow spring assembly surrounding said variable-diameter piston and fixed to said main shaft located at one end of said bow spring assembly is configured to slide along said main shaft.

11. The apparatus of claim 1, wherein said main shaft comprises:

an elongated cylindrical body formed of metal having a longitudinal bore disposed therethrough.

12. The apparatus of claim 1, wherein said main shaft comprises:

means for coupling a second tool to a lower end of said main shaft, wherein said means includes a connection for an electrical conductor.

13. The apparatus of claim 1, wherein said variable-diameter piston comprises:

said hollow elastomeric cylinder having predetermined inside and outside diameters; and a retaining ring formed of machined metal attached to a lower end thereof.

14. A fluid-saving pump down tool to transport a wireline tool string downward through a well casing, comprising:

a variable-diameter piston assembly formed as a hollow expandable cylindrical member for being disposed in said wireline tool string between a fixed seat, a bow spring assembly surrounding said variable-diameter piston and fixed to a main shaft located at one end of said bow spring assembly and a sliding thrust bushing configured to slide along said main shaft outside said hollow expandable cylindrical member and inside said bow spring assembly, and a diameter of the variable-diameter piston is configured to expand in presence of a high volume fluid flow within said well casing and contract said diameter in absence of said high volume fluid flow, said expandable cylindrical member having a reduced wall thickness intermediate of ends thereof, wherein said reduced wall thickness intermediate of said ends thereof flexes outward under fluid pressure from fluid pumped into a wellbore, and wherein said fluid pressure from said fluid pumped into said wellbore bears against said variable-diameter piston assembly causing said wireline string tool to be conveyed through said well casing.

15. The fluid-saving pump down tool of claim 14, wherein said hollow expandable cylindrical member further comprises:

a resilient cylinder, having a variable inside diameter and a coil spring enclosed concentrically there with, disposed concentrically on a main shaft coupled in said wireline tool string.

16. The fluid-saving pump down tool of claim 14, wherein:

said bow spring assembly surrounding said variable-diameter piston and fixed to a main shaft located at one end of said bow spring assembly is configured to slide along said main shaft.

17. A method for minimizing pump down fluid use during a pump down operation to transport a wireline tool downward through a well casing, comprising the steps of:

providing a fluid saver tool having a variable-diameter piston formed as a hollow, expandable cylinder, said hollow expandable cylinder having a reduced wall thickness intermediate a defined length thereof wherein said reduced wall thickness intermediate said defined length thereof flexes outward under fluid pressure from fluid pumped into a wellbore, and wherein said fluid pressure from said fluid pumped into said wellbore bears against said variable-diameter piston causing said wireline tool to be conveyed through said well casing;

disposing said hollow expandable cylinder concentric with a main shaft located between a seat fixed to said main shaft at a lower end of said cylinder and a sliding thrust bushing disposed along said main shaft at an upper end of said cylinder;

enclosing a coil spring on said main shaft between said seat and said sliding thrust bushing;

placing said fluid saver tool coupled with said wireline tool into said well; and configuring said variable-diameter piston with a reduced wall thickness along an intermediate portion thereof to expand a diameter of said hollow expandable cylinder within said well casing when said fluid flows at high volume against said hollow expandable cylinder and to contract said diameter of said hollow expandable cylinder when said fluid flow ceases.

18. The method of claim 17, wherein the step of configuring includes the step of:

configuring said variable-diameter piston of an elastomeric material with a reduced wall thickness along said defined length thereof to facilitate said variable diameter piston to expand and contract said diameter of said hollow expandable cylinder.

19. The method of claim 17, wherein the step of configuring comprises the steps of:

enabling said variable diameter piston to expand said diameter of said hollow expandable cylinder while compressing said concentric coil spring in presence of the high volume of fluid flow down said well; and ceasing said fluid flow volume to allow said coil spring to restore said variable diameter piston to a nominal diameter.

20. The method of claim 19, wherein the step of enabling comprises the step of:

allowing said coil spring to compress by a predetermined amount when said fluid flow volume increases said fluid pressure within said well casing beyond a prescribed level.

21. The method of claim 20, wherein the step of allowing comprises the step of:

balancing said fluid pressure with the tension in said coil spring to permit said variable-diameter piston to expand to said diameter of said hollow expandable cylinder near an inside diameter of said well casing.

* * * * *